US007543810B2

(12) United States Patent
Koga et al.

(10) Patent No.: US 7,543,810 B2
(45) Date of Patent: Jun. 9, 2009

(54) FEEDER FOR OBJECTS TO BE CONVEYED, AND IMAGE RECORDING DEVICE HAVING SAME

(75) Inventors: Yuji Koga, Nagoya (JP); Daisuke Kozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 331 days.

(21) Appl. No.: 11/535,671

(22) Filed: Sep. 27, 2006

(65) Prior Publication Data

US 2007/0102866 A1 May 10, 2007

(30) Foreign Application Priority Data

Sep. 27, 2005 (JP) ..... 2005-279410

(51) Int. Cl.
*B65H 3/06* (2006.01)

(52) U.S. Cl. ..... 271/109; 271/117; 271/118

(58) Field of Classification Search ..... 271/117, 271/118, 109; 492/45; 403/359.6
See application file for complete search history.

(56) References Cited

U.S. PATENT DOCUMENTS

| | | | | |
|---|---|---|---|---|
| 732,728 | A * | 7/1903 | Forsyth | 492/40 |
| 1,628,835 | A * | 5/1927 | Furbush | 492/41 |
| 3,750,250 | A * | 8/1973 | Brown | 29/895.21 |
| 4,664,252 | A * | 5/1987 | Galbraith | 198/722 |
| 5,868,385 | A * | 2/1999 | Embry et al. | 271/118 |
| 6,659,449 | B2 * | 12/2003 | Kim | 271/117 |
| 6,974,127 | B2 * | 12/2005 | Kang | 271/10.11 |
| 2004/0207145 | A1 * | 10/2004 | Chang | 271/117 |

FOREIGN PATENT DOCUMENTS

| | | |
|---|---|---|
| JP | S59-165844 U | 11/1984 |
| JP | H6 48595 | 2/1994 |
| JP | H7 228367 | 8/1995 |
| JP | H11 161038 | 6/1999 |
| JP | H11 208905 | 8/1999 |
| JP | 2003 246487 | 9/2003 |

OTHER PUBLICATIONS

Japanese Patent Office, Office Action for Japanese Patent Appl'n No. 2005-279410 (counterpart to above-captioned U.S. patent application), mailed Aug. 20, 2008.

* cited by examiner

*Primary Examiner*—David H Bollinger
(74) *Attorney, Agent, or Firm*—Baker Botts L.L.P.

(57) ABSTRACT

A feeder for an object to be conveyed has an arm having a base end and a distal end and swingable about the base end; a pair of support shafts rotatably provided on both sides of the distal end of the arm; a pair of rotary feeding members for feeding the objects to be conveyed piled in a holder while abutting on the objects to be conveyed, the pair of rotary feeding members being fitted on outer surfaces of the pair of support shafts, respectively; and a regulating unit for regulating orientations of the pair of rotary feeding members uniformly with respect to a direction in which the pair of rotary feeding members rotate, the regulating unit being provided in interfaces between the support shafts and the rotary feeding members.

17 Claims, 11 Drawing Sheets

FEEDER FOR OBJECTS TO BE CONVEYED, AND IMAGE RECORDING DEVICE HAVING SAME

CROSS-REFERENCE TO RELATED APPLICATIONS

This Nonprovisional application claims priority under 35 U.S.C. §119(a) on Patent Application No.2005-279410 filed in Japan on Sep. 27, 2005, the entire contents of which are hereby incorporated by reference.

BACKGROUND

The present invention relates to a feeder, for separating piled objects to be conveyed one by one and feeding them one by one to a predetermined position, and an image recording device having same.

Conventional image recording devices such as printers and facsimiles have a feeder that feeds a plurality of recording sheets (cut sheets, objects to be conveyed) piled on a hopper or a paper tray by the rotation of paper feed rollers (rotary feeding members). For this feeder, the following methods are in actual use: a horizontal method to pile a plurality of sheets substantially horizontally; and an inclined method to pile a plurality of sheets in a condition of being inclined vertically at an angle.

For example, Japanese Patent Application Laid-Open No. H11-208905(1999) discloses a feeder in which a pair of right and left paper feed rollers are disposed with an appropriate interval in between in a direction orthogonal to the sheet feeding direction on the top surface side of a paper feed cassette where a plurality of sheets are piled horizontally. The sheets fed by the pair of paper feed rollers are conveyed to the lower surface of a recording section through a conveyance path of an upward U-turn form having reversing rollers, undergo recording, and are then ejected to the front surface side of the housing of the image recording device.

Moreover, Japanese Patent Application Laid-Open No. H07-228367(1995) discloses that a knurled friction producing portion is formed on the outer surface of a paper feed roller parallel to the axis of the paper feed roller made of an elastic material, and the paper feed roller is irrotationally engaged with the support shaft which is provided with a groove, convex portion, or a positioning pin.

SUMMARY

It is known to grind the outer surfaces of the paper feed rollers to increase the coefficients of friction of the outer surfaces, and it is also known that the coefficient of friction varies according to the grinding direction.

Therefore, when a pair of right and left paper feed rollers are disposed like in the feeder of Japanese Patent Application Laid-Open No. H11-208905(1999), it is necessary to attach the rollers to the support shafts so that the grinding directions on the outer surfaces thereof are the same. In other words, it is necessary to make some contrivance to prevent the paper feed rollers from being attached to the support shafts in a wrong orientation. However, a feeder (paper feeder) where such contrivance is made has been heretofore absent.

The present invention is made to solve such a problem, and an object thereof is to provide a feeder, for objects to be conveyed, in which a pair of right and left paper feed rollers can be attached to the support shafts in the correct orientation by adopting a comparatively simple structure.

To attain this object, a feeder for an object to be conveyed is provided, the feeder comprising: an arm having a base end and a distal end and swingable about the base end; a pair of support shafts rotatably provided on both sides of the distal end of the arm; a pair of rotary feeding members for feeding the objects to be conveyed piled in a holder while abutting on the objects to be conveyed, the pair of rotaty feeding members being fitted on outer surfaces of the pair of support shafts, respectively; and a regulating unit for regulating orientations of the pair of rotary feeding members uniformly with respect to a direction in which the pair of rotary feeding members rotate, the regulating unit being provided in interfaces between the support shafts and the rotary feeding members.

Since the regulating unit that regulates the orientations of a pair of rotary feeding members to be uniform with respect to the direction in which the rotary feeding members rotate are formed on the outer surfaces of the support shafts and the inner surfaces of the rotary feeding members, the coefficients of friction of the right and left rotary feeding members with respect to the surface of the object to be conveyed become the same, so that the feeding force does not vary in the direction of the width of the object to be conveyed. Consequently, the occurrence of an oblique feeding phenomenon of the object to be conveyed at the time of feeding and paper jamming can be prevented.

In an image recording device, the holder of the feeder is a paper feed cassette that holds therein the object to be conveyed in a condition of being piled substantially horizontally, and is disposed in a device body case so as to be movable backward and forward, and the device body case is provided with the feeder for feeding the object to be conveyed piled in the paper feed cassette.

The feeder is applicable to an image recording device in which the objects to be conveyed are horizontally piled in the paper feed cassette with the recording surfaces thereof facing downward, and recording is performed on the recording surface under a condition where the recording surface comes to face upward through a U-turn path. The effect of separating the objects to be conveyed one from the others is further delivered and the objects to be conveyed can be surely fed till the last one.

The above and further objects and features of the invention will more fully be apparent from the following detailed description with accompanying drawings.

DETAILED DESCRIPTION OF THE EXEMPLARY EMBODIMENTS

Figure 1:
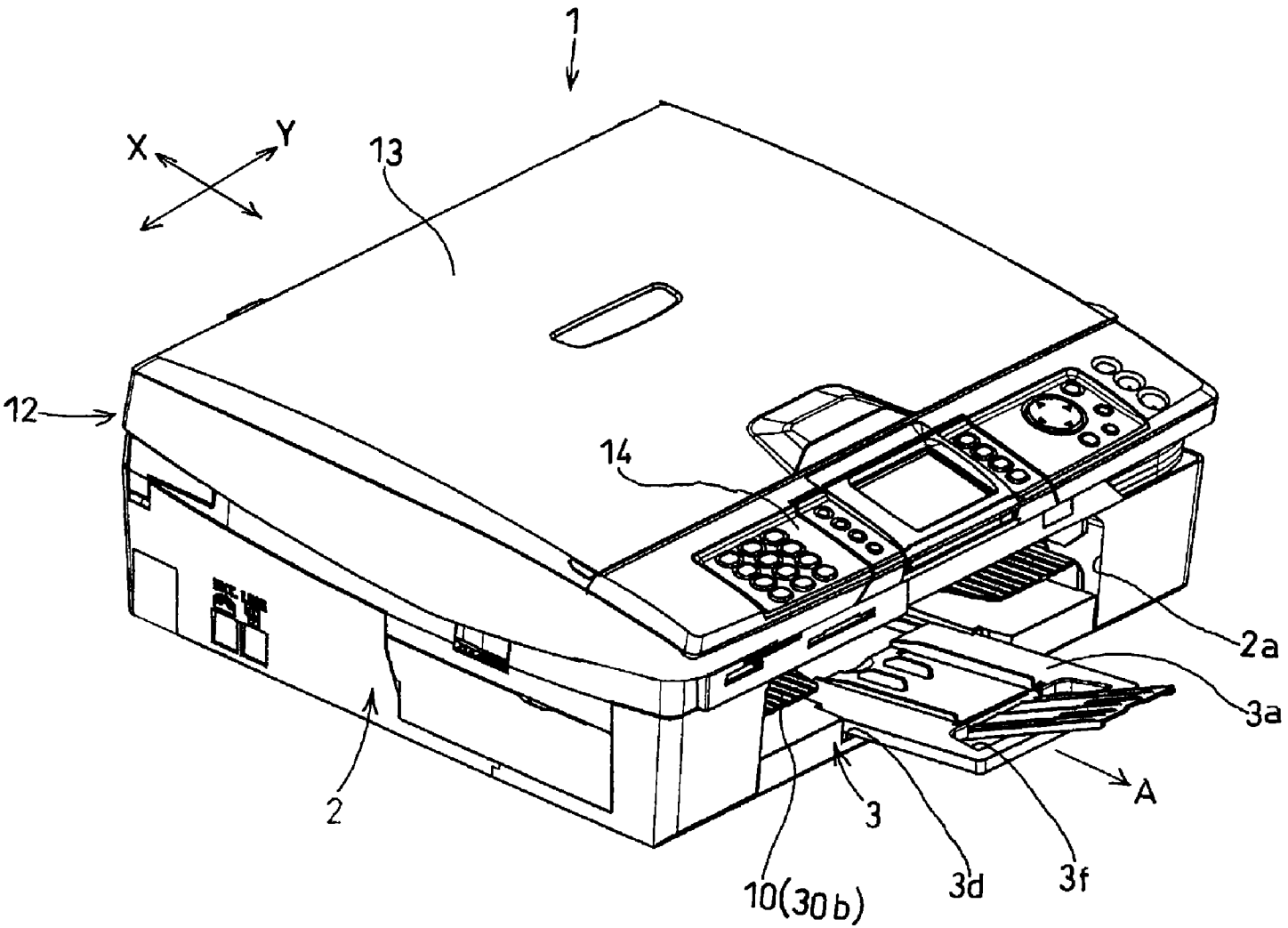
FIG. 1 is a perspective view of an image recording device having an inkjet recording head.
Figure 2:
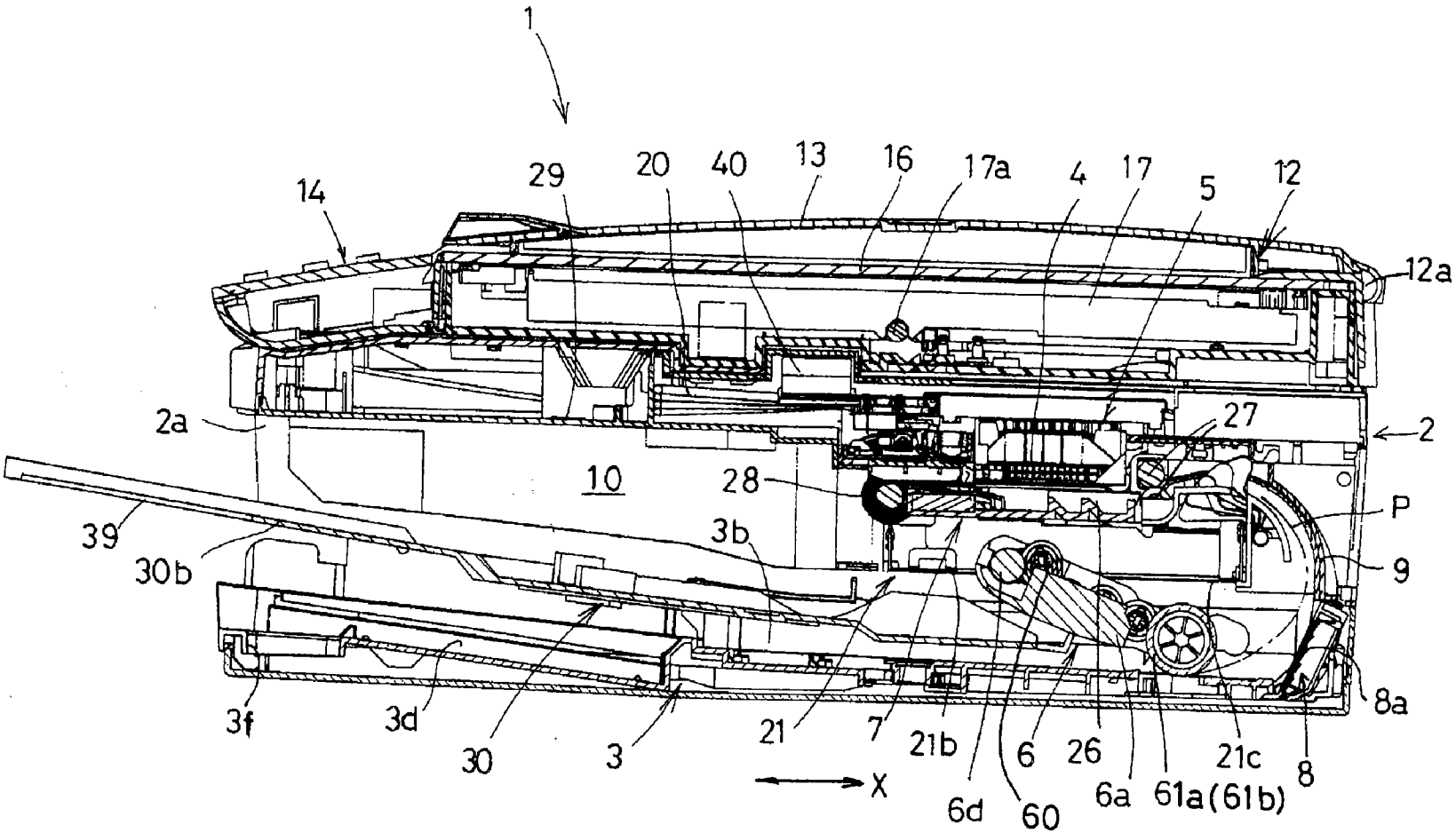
FIG. 2 is a side cross-sectional view of the image recording device of FIG. 1.

An image recording device 1 of the present embodiment is a multi function device (MFD) having a printer function, a copier function, a scanner function, and a facsimile function to which the present invention is applied. As shown in FIGS. 1 and 2, on the bottom of a housing 2, formed of an injection molded product made of a synthetic resin, that is the recording device body made of a synthetic resin in the image recording device 1, a main paper feed cassette 3 as an example of a holder is disposed that is capable of being inserted through an opening 2*a* on the front side (the left side in FIG. 2) of the housing 2. On the top surface of the main paper feed cassette 3, an auxiliary paper feed cassette 30 described later is coupled or placed so as to be movable backward and forward. In the description that follows, in the image recording device 1, the side where the opening 2*a* is present will be referred to as the front part, the front side or the front end, and the side farthest from the opening 2*a* will be referred to as the rear part, the rear side or the rear end.

An image reader 12 for original reading in the copier function and the facsimile function is disposed above the housing 2. The image reader 12 is vertically openably and closably pivotable with respect to one end of the housing 2 through a non-illustrated pivot portion. The rear end of an original cover body 13 that covers the top surface of the image reader 12 is attached to the rear end of the image reader 12 so as to be vertically pivotable about a pivot 12*a*.

Above the housing 2, an operation panel 14 having various operation buttons, a liquid crystal display and the like is provided in front of the image reader 12. A placement glass plate 16 where the original can be placed by upwardly opening the original cover body 13 is provided on the top surface of the image reader 12. Below the glass plate 16, a contact image sensor (CIS) 17 for original reading is provided so as to be reciprocatable along a guide shaft 17*a* extending in a direction orthogonal to the plane of FIG. 2 (main scanning direction: the direction of the Y axis in FIGS. 1, 2 and 3).

A recording section 7, a paper output section 10, and an ink storage section 15 provided on one side of the paper output section 10 are disposed below the image reader 12 and the operation panel 14 so as to be situated within the two-dimensional projected area thereof.

As shown in FIG. 2, a first and second guide members 22 and 23 of an elongated plate form extending in the direction of the Y axis (main scanning direction) are supported by a box-shaped main frame 21 opened at the top and a pair of right and left side plates thereof. The recording section 7 is provided between the first and second guide members 22 and 23 (see FIG. 3). A carriage 5 provided with a recording head 4 in the recording section 7 is reciprocatable while being supported (mounted) so as to be slidable over the gap between the first guide member 22 on the upstream side in the sheet feeding direction and the second guide member 23 on the downstream side.

To reciprocate the carriage 5, a timing belt 24 disposed so as to extend in the main scanning direction (the direction of the Y axis) is wound around a pulley on the top surface of the second guide member 23 disposed on the downstream side in the sheet feeding direction (the direction of the arrow A). A CR (carriage) motor 25 driving the timing belt 24 is fixed to the lower surface of the second guide member 23. While the CR motor 25 is a DC motor in the embodiment, it may be a different motor such as a stepping motor. The second guide member 23 has an encoder strip (not shown) disposed so as to extend in the main scanning direction and detecting the position of the carriage 5 in the direction of the Y axis (main scanning direction). The belt-shaped encoder strip is disposed so that the test surface (the surface where slits arranged at regular intervals in the direction of the Y axis are formed) is in the vertical direction.

A flat platen 26 extending in the direction of the Y axis so as to face the lower surface of the recording head 4 on the carriage 5 is fixed between the guide members 22 and 23 and above a bottom plate 21*b* of the main frame 21.

Figure 3:
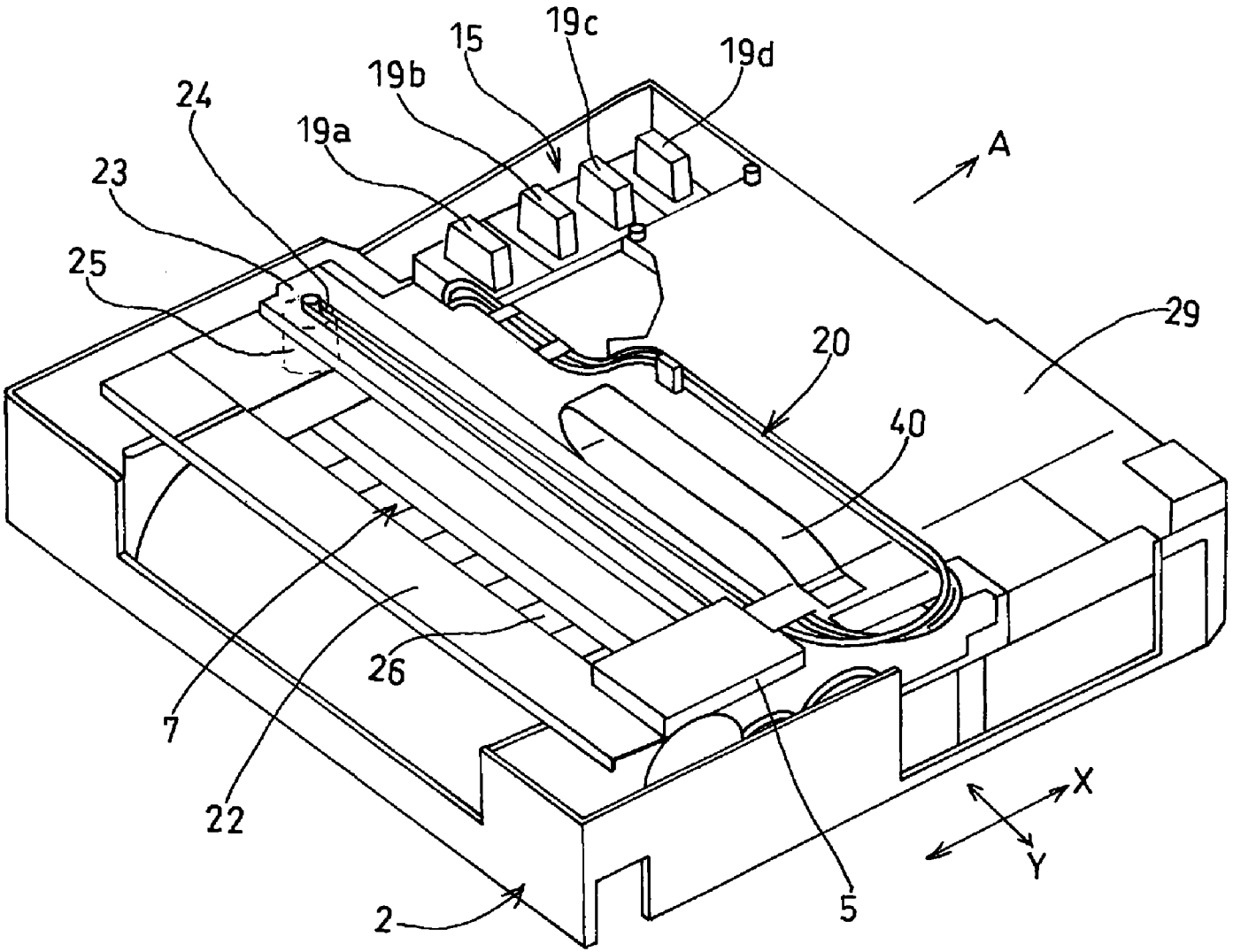
FIG. 3 is a perspective view of the recording device body in a condition where an image reader is removed.

A partitioning plate 29 made of a synthetic resin covering the paper output section 10 between the lower surface of the second guide member 23 on the downstream side in the sheet feeding direction and the opening 2*a* (used also as the paper output opening) at the front end of the housing 2 is formed integrally with the housing 2 (see FIGS. 2 and 3).

The ink storage section 15 is opened toward the top of the housing 2. The ink storage section 15 is detachably attachable from above, and capable of housing, in a row in the direction of the X axis, substantially rectangular box-shaped ink cartridges 19 (cartridges of inks of individual colors, that is, inks of black (BK), cyan (C), magenta (M) and yellow (Y) are denoted by reference numerals 19*a* to 19*d*, see FIG. 3) that are small in two-dimensional area and large in height and contain inks of four colors for full-color recording, respectively.

The inks are supplied from the ink cartridges (individually denoted by reference numerals 19*a* to 19*d*) to the ink-jet recording head 4 through a plurality of (four in the embodiment) ink supply tubes 20. When more than four colors of inks are used (six to eight colors, etc.), ink cartridges according to the number of ink colors are structured so that they can be housed in the ink storage section 15, and the number of ink supply tubes 20 is also increased according to the number of ink cartridges.

As shown in FIG. 3, the base portions of a plurality of (four in the embodiment) ink supply tubes 20 are bundled together at a part of one end of the ink storage section 15, and extend on the top surface of the partitioning plate 29 from one side end thereof (the left end in FIG. 3) toward the other end (the right end in FIG. 3) in the direction of the Y axis. At this time, the base portions of all the ink supply tubes 20 are laterally arranged in a row along the top surface of the substantially horizontal partitioning plate 29. At least part (intermediate part, etc.) of the ink supply tubes 20 is held by the top surface of the partitioning plate 29.

In the recording section 7, outside the width of the sheet as the object to be conveyed (the short side of the sheet P housed in the main paper feed cassette 3), an ink receiver is disposed on the side of one end thereof, and a maintenance unit is disposed on the side of the other end (these are not shown). Thereby, the recording head 4 periodically performs ink jetting for the prevention of nozzle clogging during the recording operation in a flushing position provided opposite to the ink receiver, and the ink is received by the ink receiver. In the part of the maintenance unit, the carriage 5 is in a standby position, and the cap portion (not shown) in the maintenance unit covers the nozzle surface of the recording head 4 from below to thereby selectively suck the ink of each color and restoration processing to remove bubbles in a non-illustrated buffer tank on the recording head 4 is performed. When the carriage 5 laterally moves so as to approach the part of the maintenance unit, the nozzle surface is wiped for cleaning by a non-illustrated cleaner (wiper blade).

A flexible flat cable 40 for transmitting, from a non-illustrated controller provided on the side of the housing 2, a command signal to cause ink drops to be selectively jetted from the nozzle of the recording head 4 mounted on the carriage 5 is disposed substantially parallel to the direction in which the ink supply tubes 20 extend in an area where the ink supply tubes 20 pass when the carriage 5 reciprocates in the direction of the Y axis (main scanning direction) (see FIG. 3).

A pair of registration rollers (conveyance rollers) 27 for sending the sheet (P or P1) to the lower surface of the recording head 4 are disposed on the conveyance upstream side of the platen 26. A paper output roller 28 and a spur (not shown) for conveying the sheet having undergone recording to the paper output section 10 are disposed on the downstream side of the platen 26 (see FIG. 2).

Figure 4:
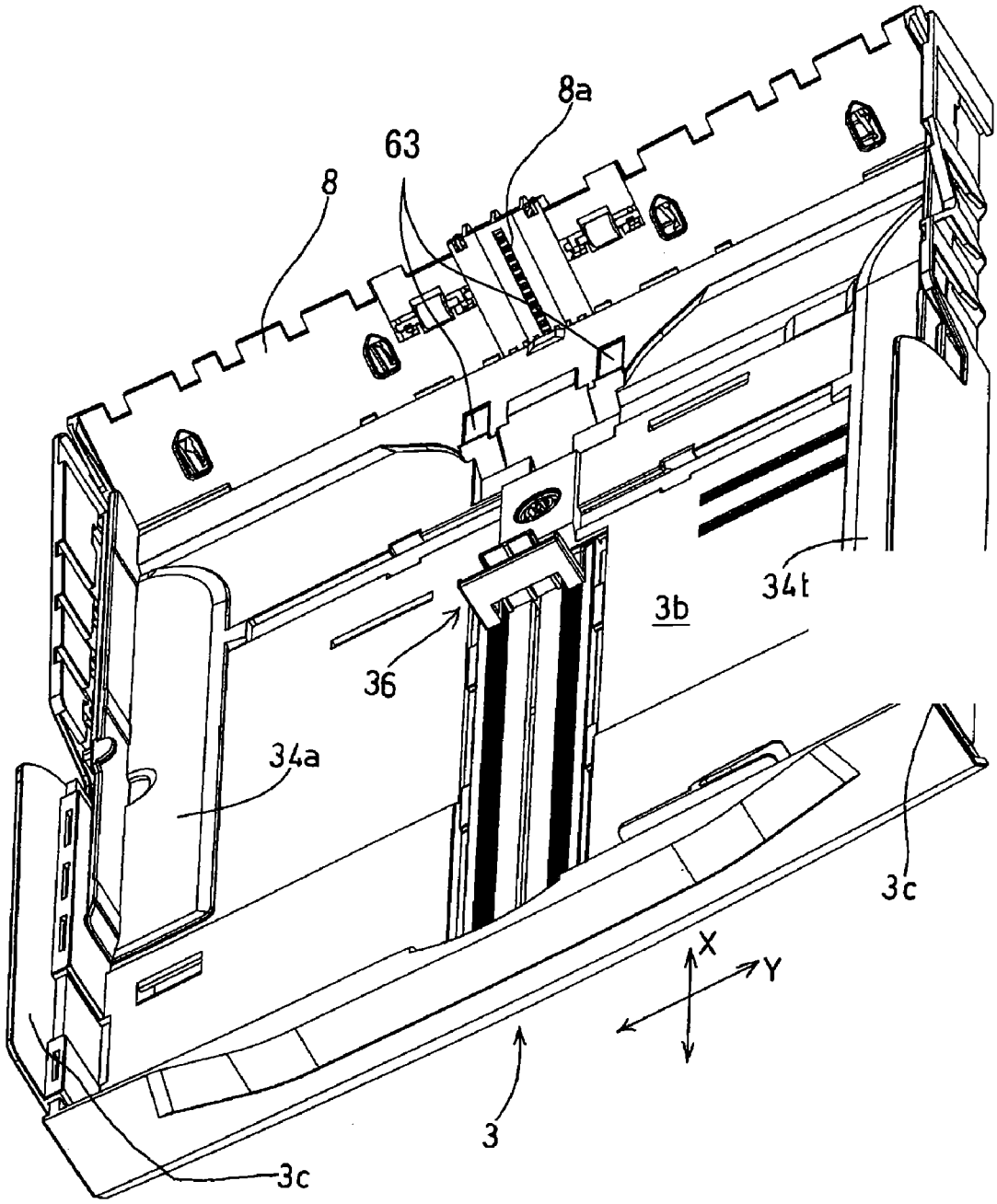
FIG. 4 is a perspective view of a main paper feed cassette.
Figure 5:
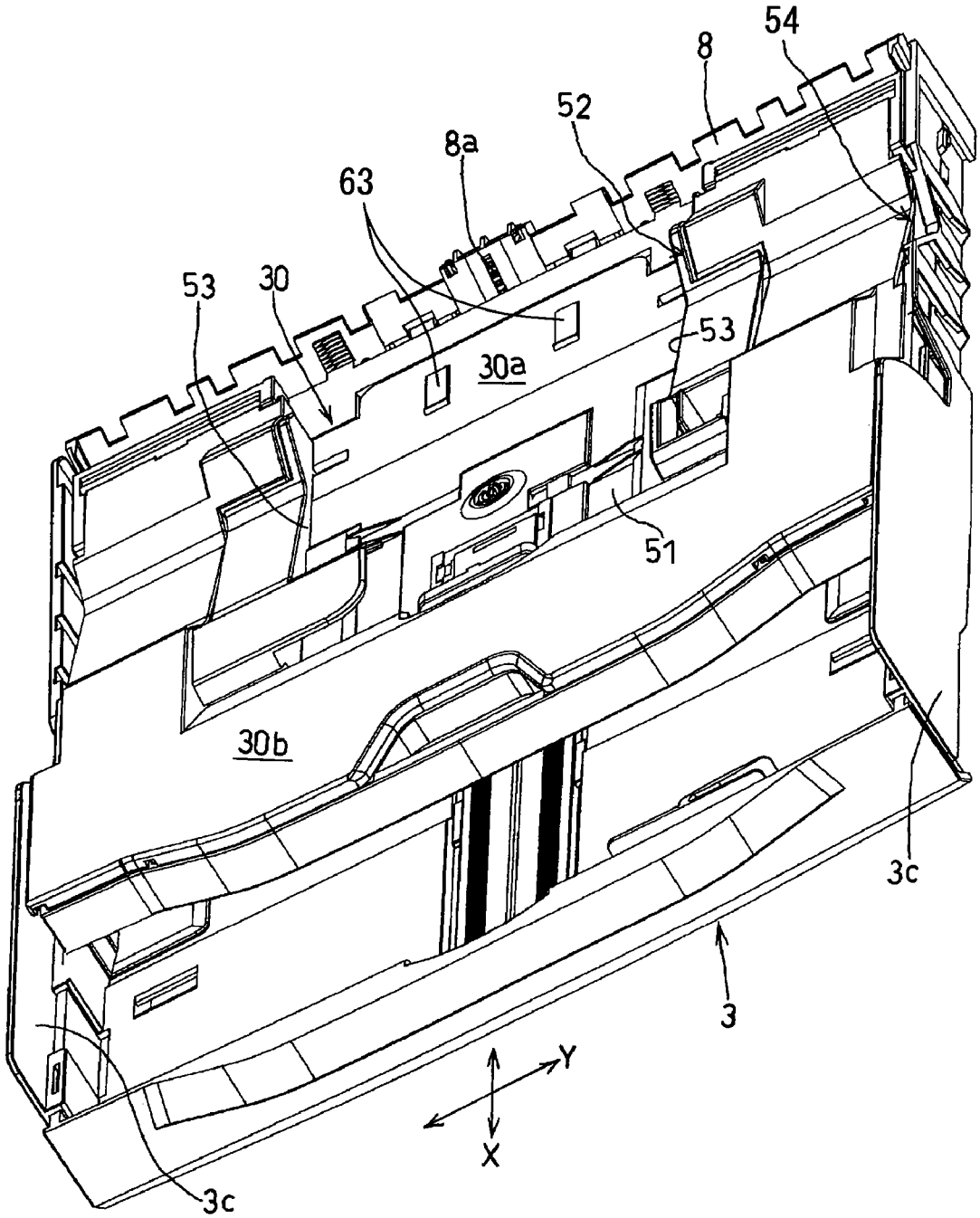
FIG. 5 is a perspective view depicting a condition where an auxiliary paper feed cassette is mounted on the main paper feed cassette.

Next, the structure of the feeder (paper feeder) will be described in detail. In the present embodiment, the main paper feed cassette 3 and the auxiliary paper feed cassette 30 are provided as the paper feed cassettes as shown in FIGS. 4 and 5. The main paper feed cassette 3 has a holder 3*b* capable of holding a multiplicity of sheets P in a condition of being piled (see FIG. 4), and the sheets P in the holder 3*b* are fed one by one to the recording section 7 by a feeding mechanism 6. On the other hand, the auxiliary paper feed cassette 30 is disposed so as to be movable backward and forward with respect to the main paper feed cassette 3 above the holder 3*b* of the main paper feed cassette 3, and has a placement portion 30*a* where a plurality of sheets (not shown) of sizes smaller than the sheets P in the main paper feed cassette 3 can be held in a condition of being piled.

In the main paper feed cassette 3, as the sheets P, media to be recorded that are cut into large sizes such as A4 size, letter size and legal size are held in a condition where a plurality of sheets are loaded (piled) so that the short sides thereof extend in the direction of the Y axis (main scanning direction). In the embodiment, the maximum number of sheets P that can be piled in the holder 3*b* of the main paper feed cassette 3 is approximately 100 in the case of plain paper, and the maximum height of sheets being piled is approximately 10 mm. A structure may be employed such that as shown in FIGS. 1 and 2, a concave portion 3*d* is provided at the rear end of the main paper feed cassette 3 (corresponding to the front side of the housing 2) and an auxiliary support member 3*a* for supporting the rear ends of long sheets P such as legal-size sheets is movably attached in the sheet feeding direction (sub scanning direction: the direction of the X axis). A handle 3*f* which is easy to grab with fingers may be provided near the rear end of the concave portion 3*d* and the auxiliary support member 3*a* so that the main paper feed cassette 3 is easily inserted into and extracted from the opening 2*a* of the main paper feed cassette 3. The concave portion 3*d*, the auxiliary support member 3*a* and the handle 3*f* are not shown in FIG. 3 and succeeding figures.

Within the holder 3*b* of the main paper feed cassette 3, a pair of right and left side guide members 34*a* and 34*b* as a guide unit for guiding and positioning the side end parallel to the feeding direction of the sheet P are provided so as to be movable (slidable) so that the distance therebetween is increased and decreased in a direction orthogonal to the feeding direction of the sheet P (see FIG. 4). A rack member (not shown) connected to the bottoms of the pair of right and left guide members 34*a* and 34*b* is structured so as to mesh with a gear disposed in the position of the center line, in the direction of the width, of the bottom plate of the main paper feed cassette 3 so that the center line, in the direction of the width (direction orthogonal to the feeding direction of the sheet P) of the paper feed cassette 3 and the center line, in the direction of the width, of the sheet P coincide with each other, that is, so-called center position alignment is performed. Moreover, a rear end guide member 36 that guides the rear end of the sheet P is structured so that it is movable backward and forward along a rail within the holder 3*b* and can be latched in an appropriate front or rear position (see FIG. 4).

An inclined separating plate 8 for sheet separation is disposed at the front end of the main paper feed cassette 3 (in FIG. 2, the right side, the most downstream side end in the feeding direction). The sheets P piled in the main paper feed cassette 3 or the sheets P1 piled in the auxiliary paper feed cassette 30 are separated and conveyed one by one by the cooperation of a paper feed roller 6*b* of the feeding mechanism 6 described later and a separator 8*a* provided at the center in the direction of the width (Y direction) of the inclined separating plate 8. The separated sheet P is fed to the recording section 7 provided above (in a higher position than) the main paper feed cassette 3 through a conveyance path member 9 for an upward and lateral U-turn path (paper feeding and conveying path). The sheet P having undergone recording at the recording section 7 is ejected to the paper output section 10 communicating with the opening 2*a* with its recording surface facing upward.

In the auxiliary paper feed cassette 30, as shown in FIG. 5, the bottom plate is provided as the placement portion 30*a* for the sheets P1. On the placement portion 30*a*, a multiplicity of sheets of sizes smaller than the size of the sheets P piled in the main paper feed cassette 3 (for example, postcards or L-size photo paper) can be piled. The sheets may be not only sheets different in size from the sheets P generally held in the main paper feed cassette 3 in a condition of being piled but also sheets different in kind such as paper for inkjet printers only or glossy paper for photo quality prints. The position of the sheets P1 being placed is determined so as to be parallel in the feeding direction by a pair of right and left guide members 53 provided in the placement portion 30*a*. In the placement portion 30*a*, a movable member 51 pivotally displaced upward when sheets are fed to the main paper feed cassette 3 is attached to the front end side of the auxiliary paper feed cassette 30 through a hinge (not shown). The movable member 51 pivots so that the upstream side in the feeding direction is more widely opened than the downstream side and opens the holder 3*b* of the main paper feed cassette 3 at the top, whereby the sheet supply from the upstream side in the feeding direction to the main paper feed cassette 3 is facilitated.

Further, on the movable member 51, an ejected sheet receiver 30*b* of a large width (substantially the same width as that of the auxiliary paper feed cassette 30) is integrally formed so as to be connected to the upstream side in the feeding direction. The ejected sheet receiver 30*b* is capable of receiving small-size sheets that are placed in the auxiliary paper feed cassette 30, undergo image recording and are ejected, and is capable of surely receiving, when large-size sheets P are piled in the main paper feed cassette 3 and image recording is performed thereon, the sheets P having undergone recording in a rear part (ejected sheet receiver 30*b*) of the retracted auxiliary paper feed cassette 30 in the non-feeding position without any part lying outside the cassette 30.

As a double feeding preventing unit, base pads 63 of cork or the like as a high friction coefficient member are fixed to the holder (bottom plate) 3*b* of the main paper feed cassette 3 and the placement portion 30*a* of the auxiliary paper feed cassette 30. The double feeding preventing unit leaves one sheet P or P1, to be fed last, of the sheets P or P1 piled in the holder (bottom plate) 3*b* of the main paper feed cassette 3 or the placement portion 30*a* of the auxiliary paper feed cassette 30 at the bottom.

In the feeding mechanism 6, as shown in FIG. 2, a driving shaft 6*d* is rotatably supported by shaft holes formed in a side plate and a pair of shaft supporting plates (these are not shown) in the main frame 21. An end of the driving shaft 6*d* laterally protrudes from the base of an arm 6*a*, which is an injection molded product made of a synthetic resin, in the feeding mechanism 6.

A pair of support shafts 42*a* and 42*b* that rotate integrally with a rotation shaft 41 are rotatably supported at the distal end of the arm 6*a*, and paper feed rollers 61*a* and 61*b* as a pair of rotary feeding members made of an elastic material such as a synthetic rubber or a soft synthetic resin and having a high coefficient of friction are attached to the support shafts 42*a* and 42*b*, respectively (see FIG. 6 to FIG. 8A).

The orientations of the paper feed rollers 61*a* and 61*b* to be attached to the respective support shafts 42*a* and 42*b* are regulated by a regulating unit to be uniform with respect to the direction in which the paper feed rollers 61*a* and 61*b* rotate. Accordingly, the paper feed rollers 61*a* and 61*b* are attached to the respective support shafts 42*a* and 42*b* in the correct orientations, that is, in the same orientations with respect to the direction in which the paper feed rollers 61*a*, 62*b* rotate. In this embodiment, such regulating unit is formed on interfaces between the support shafts and the rotary feeding members, that is, on the outer surfaces of the support shafts 42*a* and 42*b* and the inner surfaces of the paper feed rollers 61*a* and 61*b*.

Figure 6:
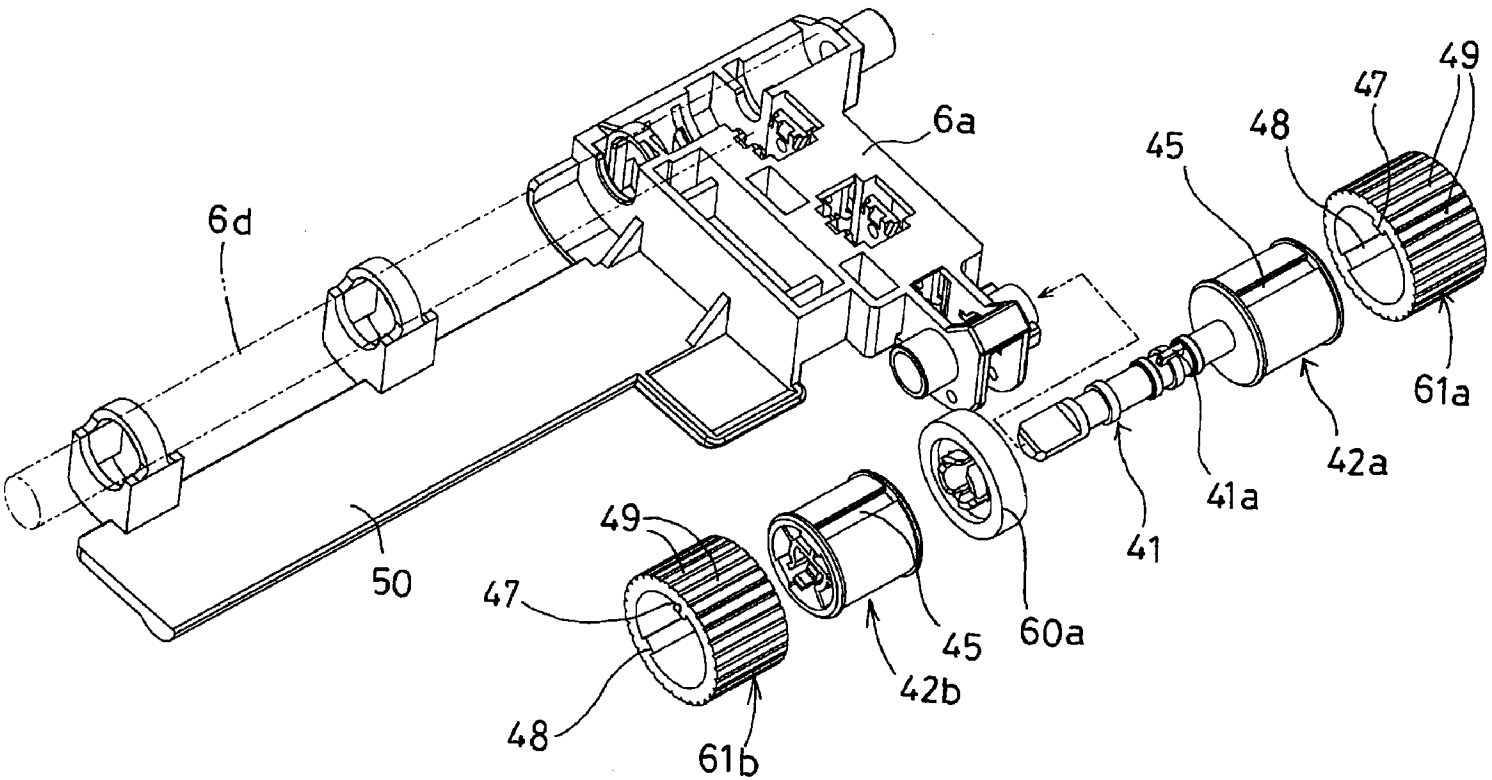
FIG. 6 is an exploded perspective view of feeding mechanism.
Figure 7:
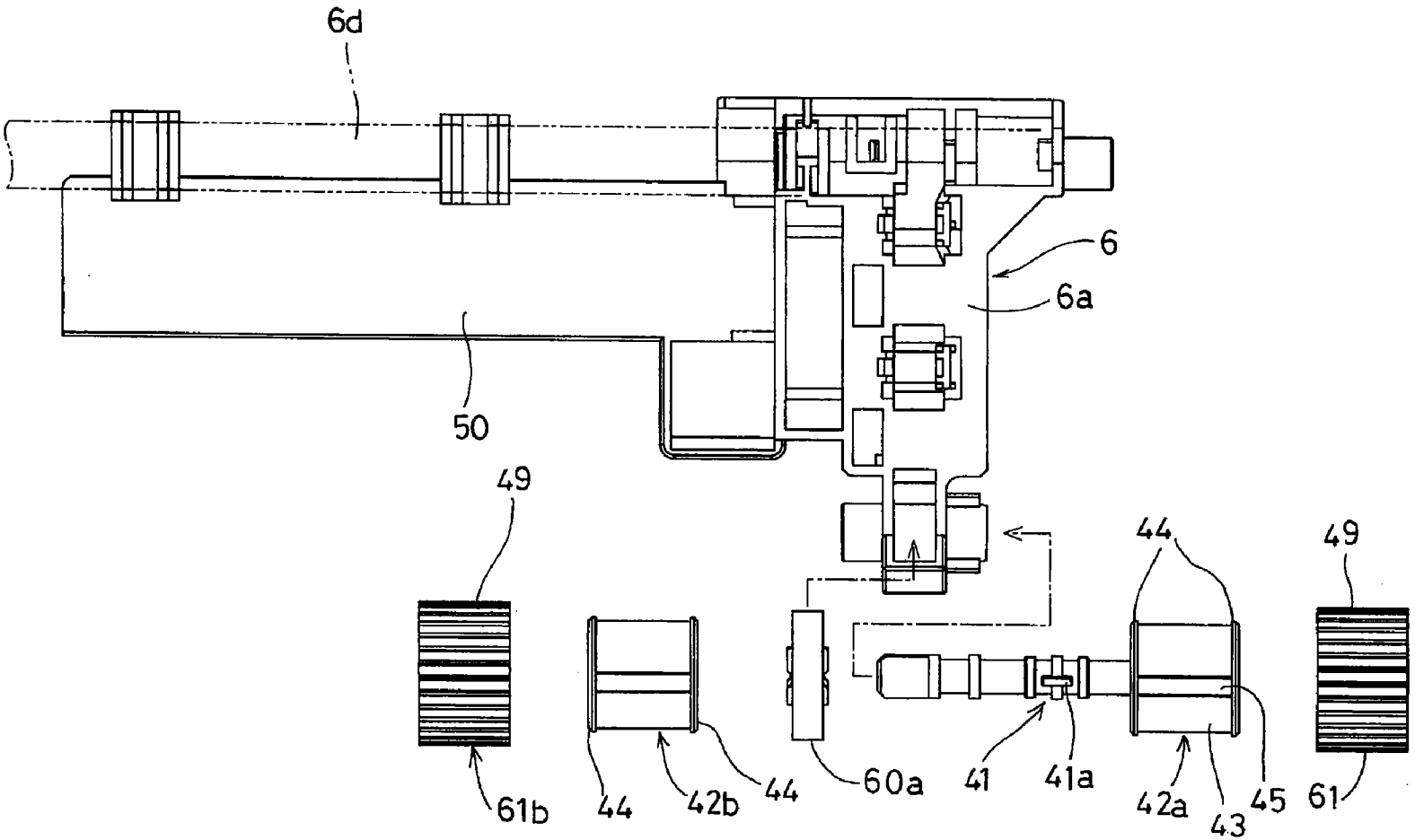
FIG. 7 is an exploded plan view of the feeding mechanism.

By the rotation of the driving shaft 6*d*, the right and left paper feed rollers 61*a* and 61*b* rotate in a predetermined direction (counterclockwise in FIG. 2) through a gear driving mechanism 60 (only a last gear 60*a* is shown in FIGS. 6 to 8) provided in the arm 6*a*. The paper feed rollers 61*a* and 61*b* are pressed downward at all times by a non-illustrated pressing member (for example, torsion spring).

Next, with reference to FIG. 6 to FIGS. 8A and 8B, a structure for attaching the pair of paper feed rollers 61*a* and 61*b* to the support shafts 42*a* and 42*b* will be described as a first embodiment of the regulating unit. The small-diameter rotation shaft 41 and one large-diameter support shaft 42*a* are integrally formed of an injection molded product made of a synthetic resin. The other large-diameter support shaft 42*b* is separately formed so as to be detachably attachable to the other end of the rotation shaft 41. On an intermediate part of the rotation shaft 41, a noncircular member 41*a* is fitted so that the above-mentioned last gear 60*a* rotates integrally.

Figure 8A:
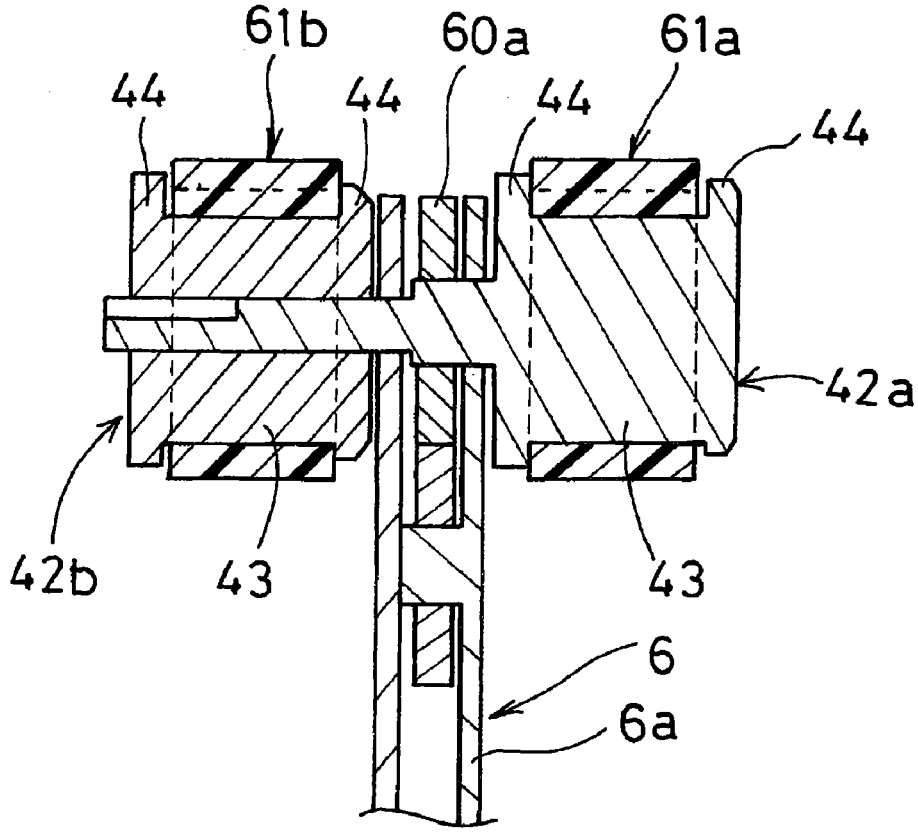
FIG. 8A is a cross-sectional view depicting a condition where a pair of right and left support shafts and paper feed rollers are attached to an arm.
Figure 8B:
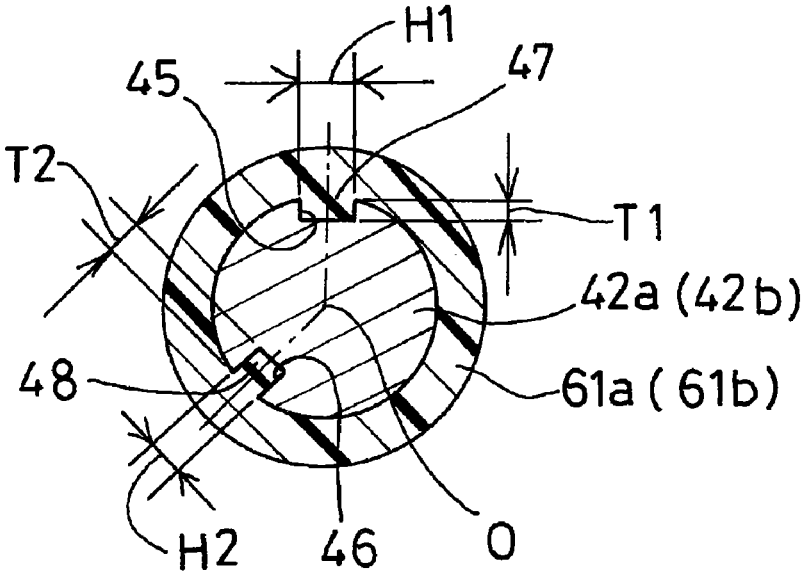
FIG. 8B is a cross-sectional view depicting one example of the arrangement of engagement grooves and protruded ribs.

The pair of support shafts 42*a* and 42*b* have bosses 43 that are circular in cross section and where the paper feed rollers 61*a* and 61*b* as a pair of rotary feeding members are fitted, and slightly large-diameter rims 44 formed at both ends of the bosses 43. A plurality of (two in the embodiment) engagement grooves 45 and 46 extending parallel to the rotation axis O (see FIG. 8B) of the rotation shaft 41 are formed on the outer surface of each boss 43. The two engagement grooves 45 and 46 are placed at positions which are asymmetrical around the rotation axis O. In other words, central angles defined by the positions of the engagement grooves 45 and 46 with respect to the rotation axis O are different from each other. For example, as shown in FIG. 8B, the engagement groove 46 is formed in a position different from the position of the engagement groove 45 by an angle larger than 180 degrees and smaller than 360 degrees (225 degrees as an example) clockwise about the rotation axis O.

The inner diameters of the pair of paper feed rollers 61*a* and 61*b* are substantially equal to the diameters of the bosses 43, and protruded ribs 47 and 48 to be fitted in the engagement grooves 45 and 46 are integrally formed on the inner surface of each of the paper feed rollers 61*a* and 61*b*. Thus, the two protruded ribs 47 and 48 extend parallel to the rotation axis O (see FIG. 8B) of the rotation shaft 41, and the two protruded ribs 47 and 48 are placed at positions which are asymmetrical around the rotation axis O. In other words, central angles defined by the positions of the protruded ribs 47 and 48 with respect to the rotation axis O are different from each other. A knurled friction producing portion 49 is formed on the outer surface of each of the pair of paper feed rollers 61*a* and 61*b*. By forming the knurled portion in advance, the coefficient of friction of the outer surface of each of the rotary feeding members can be easily increased.

In a case where the cross-sectional shapes of the two protruded ribs 47 and 48 (the amounts of protrusion in the radial direction and the widths in the circumferential direction of the protruded ribs) are the same, when one paper feed roller 61*a* is reversely rotated around the axis orthogonal to the rotation axis O so as to be upside down, and then is rotated by a predetermined angle (45 degrees clockwise in this embodiment), the angular relation between the two protruded ribs 47 and 48 of the paper feed roller 61*a* become the same as that of the other paper feed roller 61*b*. However, the orientations of the paper feed rollers 61*a* and 61*b* with respect to their rotation direction become opposite to each other. The coefficients of friction on the outer surfaces of the two paper feed rollers 61*a* and 61*b*, which vary depending on their orientations, become different from each other. When the coefficients of friction on the outer surfaces of the right and left paper feed rollers 61*a* and 61*b* are different from each other, even if the forces of pressing against the surface of the sheet P and the circumferential velocities of the right and left paper feed rollers 61*a* and 61*b* are the same, the feeding force in the direction of the width of the sheet P varies and an oblique feeding phenomenon of the sheet P occurs at the time of feeding, which causes a paper jam.

To eliminate such a problem, that is, to prevent the pair of paper feed rollers 61*a* and 61*b* from being attached to the support shafts 42*a* and 42*b* in opposite orientations to each other with respect to their rotation direction, the two protruded ribs 47 and 48 and the two engagement grooves 45 and 46 are formed so as to have different cross-sectional shapes. As an example thereof, the protruded ribs 47 and 48 are formed so that the radial direction protrusion amounts T1 and T2 thereof and the circumferential direction widths H1 and H2 thereof are different from each other. Likewise, the two engagement grooves 45 and 46 are formed so that the radial direction depths T1 and T2 thereof and the circumferential direction widths H1 and H2 thereof are different from each other (see FIG. 8B).

With this structure, for example, in FIGS. 6 and 7, the right paper feed roller 61*a* is fitted from the right end side of the boss 43 of the right support shaft 42*a* over the rim 44, and the two protruded ribs 47 and 48 on the inner surface of the paper feed roller 61*a* are fitted in the two engagement grooves 45 and 46 of the boss 43 so that the phases thereof coincide with each other.

Then, the last gear 60*a* is disposed at the distal end of the arm 6*a*, the rotation shaft 41 is inserted from the right side of the arm 6*a*, and the last gear 60*a* is attached to the rotation shaft 41. On the other hand, the left paper feed roller 61*b* is fitted from the left end side of the boss 43 of the left support shaft 42*b* over the rim 44, and the two protruded ribs 47 and 48 on the inner surface of the paper feed roller 61*b* are fitted in the two engagement grooves 45 and 46 of the boss 43 so that the phases thereof coincide with each other. Then, the left support shaft 42*b* is fitted on an end of the rotation shaft 41, and at that time, the phases of the two engagement grooves 45 and 46 and the two protruded ribs 47 and 48 of the right and left spindles 42*a* and 42*b* are made to coincide.

A friction producing portion is formed by grinding the outer surface (circumferential surface) of each of the paper feed rollers 61*a* and 61*b* in a predetermined rotation direction (predetermined circumferential direction) such that the coefficient of friction of each of the rollers 61*a* and 61*b* in the predetermined rotation direction is higher than that in the reverse rotation direction. Therefore, the right and left paper feed rollers 61*a* and 61*b* should be attached to the arm 6*a* with their orientations uniform with respect to the direction in which the paper feed rollers 61*a* and 61*b* rotate. By doing this, the feeding action in the direction of the width of the sheet P by the right and left paper feed rollers 61*a* and 61*b* is not different between the right and left sides, so that the oblique feeding of the sheet P is prevented.

On the right and left paper feed rollers 61*a* and 61*b* having such a configuration, two protruded ribs 47 and 48 are formed, two engagement grooves 45 and 46 are formed on the bosses 43 of the pair of support shafts 42*a* and 42*b*, and these are fitted together so that the phases thereof coincide.

As a second embodiment to attach the right and left paper feed rollers 61*a* and 61*b* to the arm 6*a* with their orientations uniform with respect to the direction in which the paper feed rollers 61*a* and 61*b* rotate, a combination of three or more protruded ribs of the feed rollers 61*a* and 61*b* and three or more engagement grooves of a pair of support shafts 42*a* and 42*b* corresponding to the protruded ribs is possible. In this case, the three or more protruded ribs and engagement grooves also extend parallel to the rotation axis O of the rotation shaft 41, and they are placed at positions which are asymmetrical around the rotation axis O.

Figure 9:
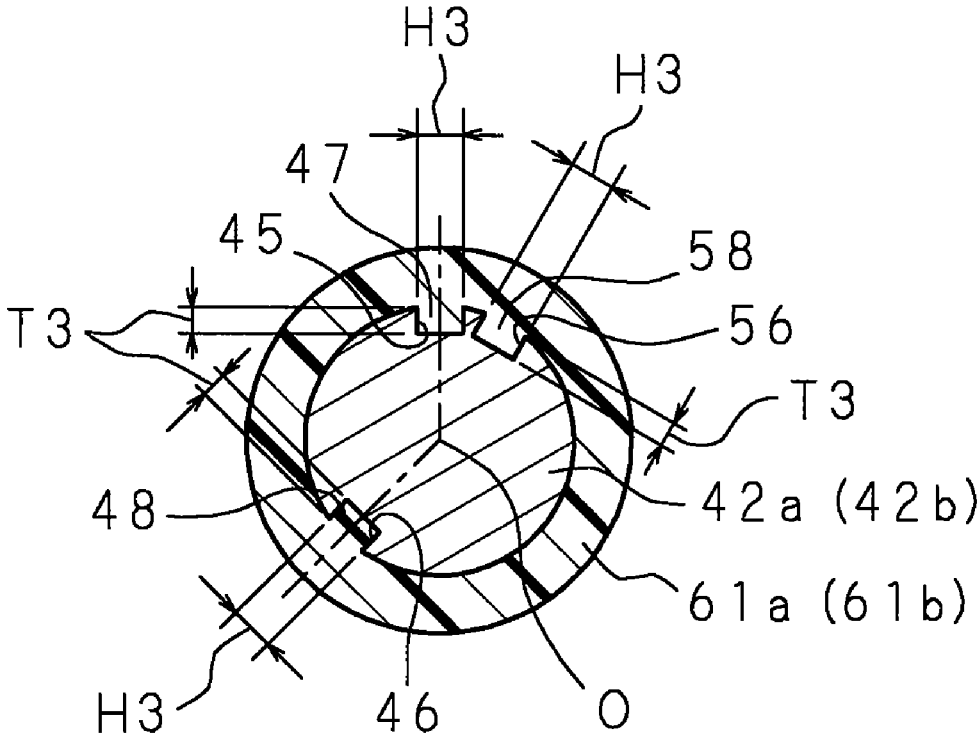
FIG. 9 is a cross-sectional view depicting another example of the arrangement of engagement grooves and protruded ribs.

FIG. 9 is a cross-sectional view depicting the arrangement of engagement grooves and protruded ribs according to the second embodiment. The positions of two engagement grooves 45 and 46 and the two protruded ribs 47 and 48 are the same as those of the embodiment shown in FIG. 8B. In the second embodiment, the third engagement groove 56 and the third protruded rib 58 to be fitted in the engagement groove 56 are formed in one position except a position different from the position of the engagement groove 45 by an angle of 135 degrees clockwise about the rotation axis O and except a position different from the position of the engagement groove 46 by an angle of 135 degrees counterclockwise about the rotation axis O. For example, as shown in FIG. 9, the engagement groove 56 and the protruded rib 58 are formed in a position different from the position of the engagement 45 by an angle of 30 degrees clockwise about the rotation axis O. The three engagement grooves 45, 46 and 56 and the three protruded ribs 47, 48 and 58 are placed at positions which are asymmetrical around the rotation axis O. In other words, central angles defined by the positions of the two adjacent protruded ribs with respect to the rotation axis O are different from each other and central angles defined by the positions of the two adjacent engagement grooves with respect to the rotation axis O are different from each other.

The circumferential direction widths of the three protruded rims 47, 48 and 58 are the same H3, and the radical direction depths of the three engagement grooves 45, 46 and 56 are the same T3. The above-described positional relation is created between the three protruded ribs 47, 48 and 58 and the three engagement grooves 45, 46 and 56, whereby although the widths of protruded rims are the same and the depths of engagement grooves are the same, the paper feed rollers 61*a* and 61*b* are not attached to the support shafts 42*a* and 42*b* in a reverse orientation but in a correct orientation.

As a modification of the first and second embodiments, a structure may be adopted such that engagement grooves are formed on the inner surfaces of the pair of paper feed rollers 61*a* and 61*b* and protruded ribs are formed on the outer surfaces of the pair of support shafts 42*a* and 42*b*.

Figure 10:
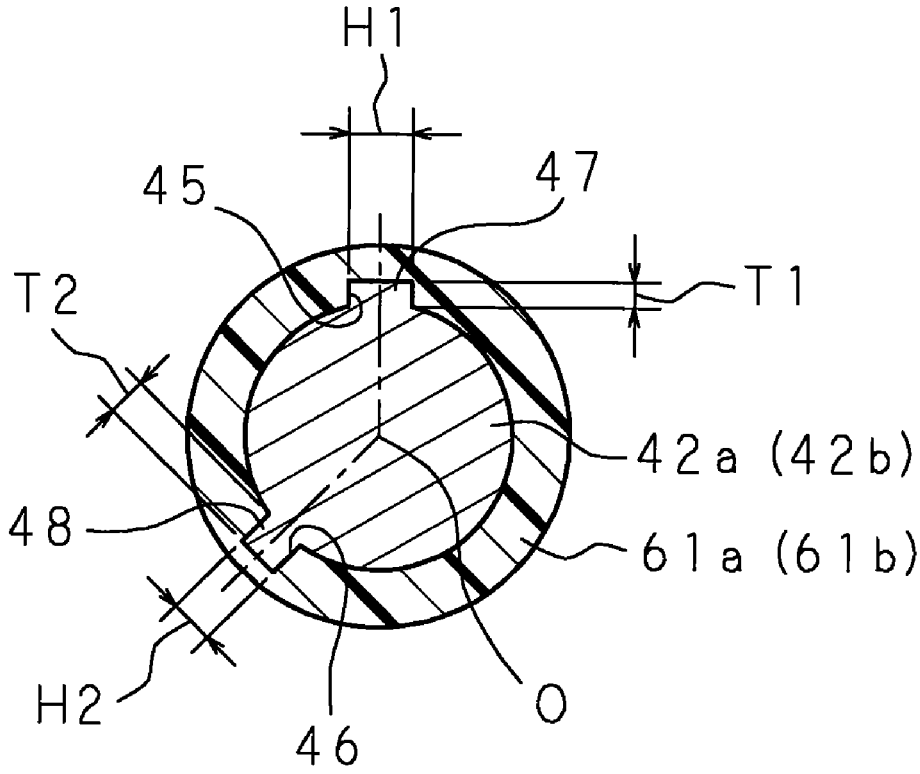
FIG. 10 is a cross-sectional view depicting a further example of the arrangement of engagement grooves and protruded ribs.

FIG. 10 is a cross-sectional view depicting the arrangement of engagement grooves and protruded ribs according to such a modification. In this modification, as shown in FIG. 10, the engagement grooves 45 and 46 are formed on the inner surface of each of the paper feed rollers 61*a* and 61*b* and the protruded ribs 47 and 48 are formed on the outer surface of each of the support shafts 42*a* and 42*b*.

Figure 11:
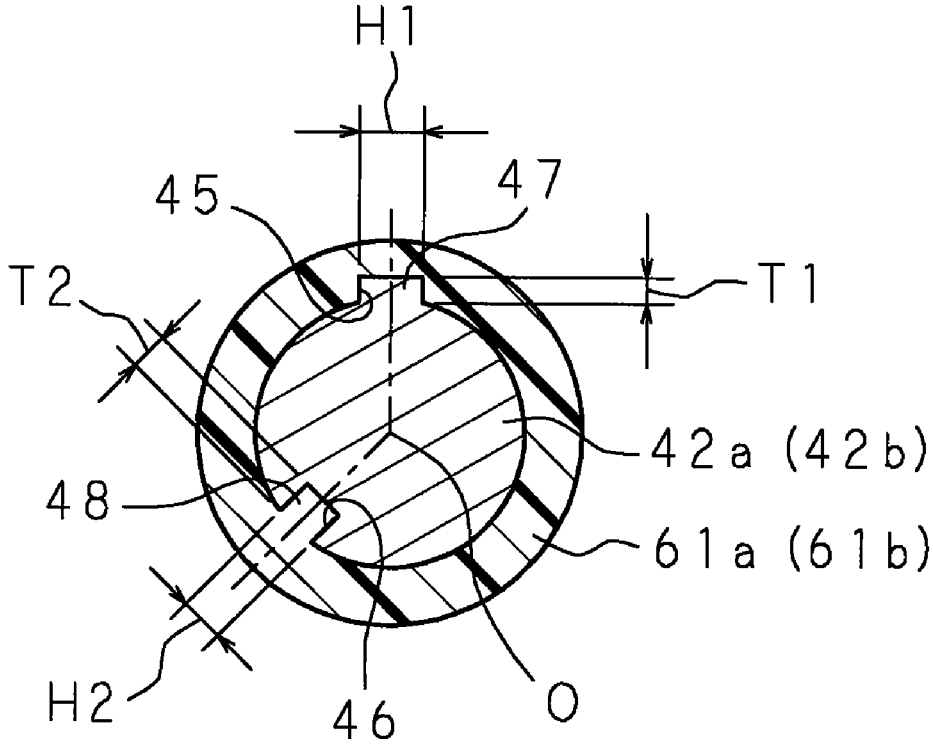
FIG. 11 is a cross-sectional view depicting a still further example of the arrangement of engagement grooves and protruded ribs.

Further, as another combination, a structure may be adopted such that an engagement groove and a protruded rib are formed on the inner surface of each of the paper feed rollers 61*a* and 61*b*, and a protruded rib and an engagement groove are formed on the outer surface of each of the support shafts 42*a* and 42*b* so as to be engaged with the groove and the rib of each of the paper feed rollers 61*a* and 61*b*. FIG. 11 is a cross-sectional view depicting the arrangement of engagement grooves and protruded ribs according to such a modification. In this modification, as shown in FIG. 11, the engagement groove 45 and the protruded rib 48 are formed on the inner surfaces of the paper feed rollers 61*a* and 61*b* and the protruded rib 47 and the engagement groove 46 are formed on the outer surfaces of the support shafts 42*a* and 42*b*.

By forming the paper feed rollers 61*a* and 61*b* of a high friction coefficient member made of a rubber or a soft synthetic resin, when fitted on the bosses 43 of the support shafts, the paper feed rollers 61*a* and 61*b* are easily elastically deformed so as to move over the rim 44, so that the attachment is facilitated.

The above-described paper feed rollers 61*a* and 61*b* of the feeding mechanism 6 are structured so as to move upward and downward as the main paper feed cassette 3 and the auxiliary paper feed cassette 30 move backward and forward. As an embodiment thereof, as shown in FIGS. 6 and 7, a substantially flat-shaped cam follower member 50 protrudes from the arm 6*a* integrally with the arm 6*a* and parallel to the driving shaft 6*d*. The cam follower member 50 extends over an auxiliary cam member 52 that is formed on the top surface of one side plate of the auxiliary paper feed cassette 30 and whose height varies. Part of an end of the cam follower member 50 further extends to a position abutting on a main cam portion 54 that is formed on the top surface of one side plate 3*c* of the main paper feed cassette 3 and whose height varies.

When the main paper feed cassette 3 and the auxiliary paper feed cassette 30 are integrally placed in the housing 2, whether the auxiliary paper feed cassette 30 is situated in the feeding position or in the non-feeding position with respect to the main paper feed cassette 3, the cam follower member 50 of the feeding mechanism 6 is guided by the main cam portion 54, the arm 6*a* moves up substantially to the horizontal, and the paper feed rollers 61*a* and 61*b* move over the inclined separating plate 8. Then, the arm 6*a* rotates downward, and the paper feed rollers 61*a* and 61*b* can abut on the sheets P1 piled in the placement portion 30*a* of the auxiliary paper feed cassette 30 or the sheets P piled in the holder 3*b* of the main paper feed cassette 3.

With the above-described structure, when the auxiliary paper feed cassette 30 is moved forward from the non-feeding position to the feeding position with the main paper feed cassette 3 being set in a predetermined position (feeding position) of the housing 2, the cam follower member 50 is guided by the auxiliary cam member 52 of the auxiliary paper feed cassette 30 to rotate the arm 6*a* first upward and then downward. Consequently, the paper feed rollers 61*a* and 61*b* can abut on the topmost surface of the sheets P1 piled in the placement portion 30*a* of the auxiliary paper feed cassette 30. Conversely, when the auxiliary paper feed cassette 30 is moved backward from the feeding position to the non-feeding position, similarly, the cam follower member 50 is guided by the auxiliary cam member 52 to rotate the arm 6*a* first upward and then downward, so that the paper feed rollers 61*a* and 61*b* can abut on the topmost surface of the sheets P piled in the holder 3*b* of the main paper feed cassette 3 without the pile of the sheets P1 on the auxiliary paper feed cassette 30 being demolished.

It is to be noted that the present invention is also applicable to feeding mechanism for a holder where the sheets P are piled so as to be inclined obliquely downward at an angle with respect to the vertical direction.

Further, when a main paper feed cassette 3 holding the sheets P in the holder 3*b* so as to be horizontally piled and being disposed so as to be movable backward and forward in the body case (housing 2) of the image recording device is used and feeding mechanism for feeding the sheets P piled in the main paper feed cassette 3 is attached to the body case so as to be rotatable upward and downward, the present invention is easily applied to printers, facsimiles, and the like, and the insertion and extraction of the main paper feed cassette 3 is easy.

It is to be noted that the present invention is applicable to feeders that convey various objects to be conveyed (for example, all kinds of objects that can be conveyed such as resin films and thin plates) to a predetermined conveyance position without any occurrence of oblique feeding or jamming, instead of the feeder of the image recording device.

As described above, according to the present invention, since a plurality of engagement grooves and the protruded ribs to be fitted in the engagement grooves are placed at positions which are asymmetrical around the rotation axis of the support shaft, the orientations of the rotary feeding members can be easily restricted only by fitting the rotary feeding members on the support shafts.

For example, on the outer surface of each support shaft, a plurality of engagement grooves extending parallel to the rotation axis thereof are formed at positions which are asymmetrical around the rotation axis, and on the inner surface of each rotary feeding member to be fitted on each support shaft, a plurality of protruded rims are formed at positions which are asymmetrical around the rotation axis so as to be fitted in only the corresponding engagement grooves. Consequently, it is only necessary that the rotary feeding member be fitted onto each rotary shaft along the rotation axis, so that the attachment can be easily performed.

Moreover, the numbers of engagement grooves and protruded ribs are two, the protruded rims are formed so that the radial direction protrusion amounts and circumferential direction widths thereof are different from each other, and the engagement grooves are formed so that the radial direction depths and circumferential direction widths thereof are different from each other. Consequently, there is no possibility that the pair of rotary feeding members are attached to the pair of rotary shafts in a wrong orientation.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A feeder for feeding objects to be conveyed, comprising:

an arm having a base end and a distal end and swingable about the base end;

a pair of support shafts rotatably provided on both sides of the distal end of the arm;

a pair of rotary feeding members for feeding the objects to be conveyed piled in a holder while abutting on the objects to be conveyed, the pair of rotary feeding members configured to be fitted on outer surfaces of the pair of support shafts, respectively; and a regulating unit for regulating orientations of the pair of rotary feeding members uniformly with respect to a direction in which the pair of rotary feeding members rotate, wherein the regulating unit is provided in interfaces between the support shafts and the rotary feeding members such that an inner surface of each of the rotary feeding members as viewed from an axial direction of the rotary feeding member is asymmetrical with respect to any line that is perpendicular to an axis of the rotary feeding member.

2. The feeder according to claim 1 wherein the regulating unit includes:

a plurality of engagement grooves formed on either one of the outer surface of each of the support shafts and an inner surface of each of the rotary feeding members; and a plurality of protrusions formed on the other of the outer surface and the inner surface and fitted in the corresponding engagement grooves, wherein the engagement grooves and the protrusions are located at positions which are asymmetrical around a rotation axis of each of the support shafts.

3. The feeder according to claim 2, wherein the number of the engagement grooves and the number of the protrusions are at least three, central angles defined by the positions of two adjacent protrusions with respect to the rotation axis of each of the support shafts are different from each other, and central angles defined by the positions of two adjacent engagement grooves with respect to the rotation axis are different from each other.

4. The feeder according to claim 2, wherein the number of the engagement grooves and the number of the protrusions are two, and the protrusions are formed so that their amounts of protrusion in a radial direction and their widths in a circumferential direction are different from each other, and the engagement grooves are formed so that their depths in the radial direction and their widths in the circumferential direction are different from each other.

5. The feeder according to claim 2, wherein on the outer surface of each of the support shafts, the plurality of engagement grooves are formed to extend parallel to the rotation axis of each of the support shafts, at positions which are asymmetrical around the rotation axis, and on the inner surface of each of the rotary feeding members fitted on the outer surface of a corresponding one of the support shafts, the plurality of protrusions are formed as protruded ribs at positions which are asymmetrical around the rotation axis, each of the protruded ribs being fitted in a corresponding one of the engagement grooves.

6. The feeder according to claim 5, wherein the number of the engagement grooves and the number of the protruded ribs are at least three, central angles defined by the positions of two adjacent protruded ribs with respect to the rotation axis of each of the support shafts are different from each other, and central angles defined by the positions of two adjacent engagement grooves with respect to the rotation axis are different from each other.

7. The feeder according to claim 5, wherein the number of the engagement grooves and the number of the protruded ribs are two, and the protruded ribs are formed so that their amounts of protrusion in a radial direction and their widths in a circumferential direction are different from each other, and the engagement grooves are formed so that their depths in the radial direction and their widths in the circumferential direction are different from each other.

8. The feeder according to claim 2, wherein on the inner surface of each of the rotary feeding members fitted on the outer surface of a corresponding one of the support shafts, the plurality of engagement grooves are formed to extend parallel to the rotation axis of each of the support shafts, at positions which are asymmetrical around the rotation axis, and on the outer surface of each of the support shafts, the plurality of protrusions are formed as protruded ribs at positions which are asymmetrical around the rotation axis, each of the protruded ribs being fitted in a corresponding one of the engagement grooves.

9. The feeder according to claim 1, wherein the regulating unit includes:

a plurality of engagement grooves and a plurality of protrusions formed in the interface between each of the support shafts and a corresponding one of the rotary feeding members, at least one of the engagement grooves being formed on the outer surface of each of the support shafts while at least one of the protrusions being formed on an inner surface of each of the rotary feeding members, and the rest of the engagement grooves being formed on the inner surface of each of the rotary feeding members while the rest of the protrusions being formed on the outer surface of each of the support shafts, wherein the plurality of protrusions are fitted in the corresponding engagement grooves, and the engagement grooves and the protrusions are located at positions which are asymmetrical around a rotation axis of each of the support shafts.

10. The feeder according to claim 9, wherein on the outer surface of each of the support shafts, the at least one of engagement grooves are formed to extend parallel to the rotation axis of each of the support shafts, and the rest of the protrusions are formed as protruded ribs, on the inner surface of each of the rotary feeding members fitted on the outer surface of a corresponding one of the support shafts, the rest of the engagement grooves are formed to extend parallel to the rotation axis of each of the support shafts, and the at least one of the protrusions are formed as protruded ribs, and the engagement grooves and the protruded ribs are located at positions which are asymmetrical around the rotation axis, each of the protruded ribs being fitted in a corresponding one of the engagement grooves.

11. The feeder according to claim 1, wherein on an outer surface of each of the rotary feeding members, a knurled friction producing portion is provided.

12. The feeder according to claim 1, wherein each of the rotary feeding members comprises:

a friction producing portion provided on an outer surface of the rotary feeding member, wherein the friction producing portion is formed by grinding the outer surface in a predetermined circumferential direction.

13. The feeder according to claim 1, wherein the rotary feeding members are each made of a rubber or a soft synthetic resin.

14. The feeder according to claim 1, wherein the pair of rotary feeding members rotate in the same direction when feeding the objects to be conveyed, each of the pair of rotary feeding members has a first circumferential direction and a second circumferential direction opposite to the first circumferential direction, and the regulating unit regulates the rotary feeding members to be oriented on the outer surfaces of the respective support shafts such that the first circumferential direction of each of the rotary feeding members coincides with the rotating direction of the rotary feeding members.

15. The feeder according to claim 14, wherein each of the pair of rotary feeding members has a higher coefficient of friction in the first circumferential direction than in the second circumferential direction.

16. The feeder according to claim 1, wherein the regulating unit is provided in the interfaces between the support shafts and the rotary feeding members such that an outer surface of each of the support shafts as viewed from an axial direction of the support shaft is asymmetrical with respect to any line which is perpendicular to an axis of the support shaft.

17. An image recording device comprising:

a body case;

a paper feed cassette disposed so as to be movable backward and forward in the body case, and holding objects to be conveyed in a condition of being piled substantially horizontally;

and a feeder provided in the body case for feeding the objects to be conveyed piled in the paper feed cassette, the feeder comprising:

an arm having a base end and a distal end and swingable about the base end;

a pair of support shafts rotatably provided on both sides of the distal end of the arm;

a pair of rotary feeding members for feeding the objects to be conveyed piled in a holder while abutting on the objects to be conveyed, the pair of rotary feeding members configured to be fitted on outer surfaces of the pair of support shafts, respectively; and a regulating unit for regulating orientations of the pair of rotary feeding members uniformly with respect to a direction in which the pair of rotary feeding members rotate, wherein the regulating unit is provided in interfaces between the support shafts and the rotary feeding members such that an inner surface of each of the rotary feeding members as viewed from an axial direction of the rotary feeding member is asymmetrical with respect to any line that is perpendicular to an axis of the rotary feeding member.

* * * * *